United States Patent [19]

Polett

[11] Patent Number: 4,573,204

[45] Date of Patent: Feb. 25, 1986

[54] SLIDE FASTENER FOR FLEXIBLE BULK CONTAINER

[76] Inventor: Walter J. Polett, 61 Algonquin Trail, Medford Lakes, N.J. 08055

[21] Appl. No.: 591,698

[22] Filed: Mar. 21, 1984

[51] Int. Cl.[4] ..... B65D 33/28; B65D 33/36; F16G 11/04

[52] U.S. Cl. ..... 383/41; 383/71; 383/74; 383/906; 24/30.5 R; 24/115 R; 222/105; 222/181; 222/185

[58] Field of Search ..... 383/41, 74, 71, 24, 383/6, 22; 222/181, 185, 105; 24/30.5 R, 115 H, 115 M, 122.6, 115 R

[56] References Cited

U.S. PATENT DOCUMENTS

| | | | |
|---|---|---|---|
| 916,802 | 3/1909 | Thompson | 383/74 X |
| 1,560,264 | 11/1925 | Ledoux | 24/30.5 X |
| 2,480,543 | 8/1949 | Brooks | 24/115 R X |
| 2,598,334 | 5/1952 | Ahlburg | 383/74 |
| 3,789,897 | 2/1974 | Saito | 222/181 X |
| 3,827,471 | 8/1974 | Gregory et al. | 383/41 X |
| 3,893,595 | 7/1975 | Khanna et al. | 222/185 |
| 4,224,970 | 9/1980 | Williamson et al. | 383/41 X |
| 4,267,868 | 5/1981 | Lowe | 383/74 X |
| 4,300,608 | 11/1981 | Cuthbertson | 383/22 X |
| 4,319,428 | 3/1982 | Fox | 24/115 H X |

FOREIGN PATENT DOCUMENTS

| | | | |
|---|---|---|---|
| 76101 | 9/1976 | Australia | 383/22 |
| 35289 | 7/1929 | France | 383/41 |

*Primary Examiner*—William I. Price
*Assistant Examiner*—Sue A. Weaver
*Attorney, Agent, or Firm*—Duffield & Lehrer

[57] ABSTRACT

A flexible bulk container includes top and bottom walls and an encircling side wall. Substantially identical flexible fill and discharge spouts are secured to the top and bottom walls, respectively. Each spout carries a cord which can be tightened around the spout for closing the same and a slide fastener on the cord for holding the cord in its tightened position. The slide fastener is comprised of a flexible plastic tube which frictionally fits around the cord. An additional cord is attached to the slide fastener associated with the discharge spout so that the fastener can be slid into its open position from a remote location thereby protecting the workman opening the discharge spout. The top and bottom walls are each also provided with a pocket into which their respective folded spout can be inserted. The pockets are each held closed by drawstrings which are also provided with similar slide fasteners.

3 Claims, 6 Drawing Figures

SLIDE FASTENER FOR FLEXIBLE BULK CONTAINER

BACKGROUND OF THE INVENTION

The present invention is directed toward flexible bulk containers and more particularly toward slide fasteners for use with the filling and discharge spouts of the container.

Large, flexible fabric bags for containing and transporting granular or powdered bulk material have been used for many years and their use is becoming increasingly more popular. This is primarily due to their relatively low cost and to the fact that when the bags are empty they take up very little space and are relatively light. When filled, the flexible bulk containers may carry a cubic meter or more of material and may weigh in excess of two tons. The containers are normally provided with straps or the like adjacent the top thereof so that the containers can be transported by forklift trucks or the like. Containers of this type are shown, for example, in U.S. Pat. Nos. 4,010,784; 4,081,011; 4,300,608; 4,301,848 and in British Application No. GB 2,063,816 A published June 10, 1981.

The fill and discharge spouts of the containers are normally comprised of a flexible material similar to the material from which the containers themselves are made. These spouts are substantially tubularly shaped when they are in their full open position and are normally closed by simply tying a cord therearound. Most commonly, the cord is permanently attached to the spout by having a centrally located portion thereof sewn to the spout. The conventional method for securing the cord to the spout is simply by tying a knot in the same.

U.S. Pat. Nos. 4,081,011; 4,300,608 and 4,301,848 show examples of bulk containers utilizing cords and knots for closing the spouts thereof.

Although flexible bulk containers are relatively inexpensive, they are intended to be reusable. Thus, when it is necessary to open a spout, it is desirable to untie the knot which had been made in the cord. Unfortunately, this is not always easy to do especially with respect to the discharge spout. The problem with the discharge spout is that a workman would have to be standing under the container which may have two tons of material therein while he is attempting to untie the knot. It is not uncommon, therefore, for workmen to merely cut the cord or the spout with a knife to open the same. If the container itself is cut, it becomes worthless and must be discarded. If the cord is cut, a new cord must be sewn or otherwise attached to the spout before the container can be used again.

SUMMARY OF THE INVENTION

The present invention is designed to overcome the problems of the prior art described above. This is accomplished, according to the invention, by providing a flexible bulk container which includes top and bottom walls and an encircling side wall. Substantially identical flexible fill and discharge spouts are secured to the top and bottom walls, respectively. Each spout carries a cord which can be tightened around the spout for closing the same and a slide fastener on the cord for holding the cord in its tightened position. The slide fastener is comprised of a flexible plastic tube which frictionally fits around the cord. An additional cord is attached to the slide fastener associated with the discharge spout so that the fastener can be slid into its open position from a remote location thereby protecting the workman opening the discharge spout. The top and bottom walls are each also provided with a pocket into which their respective folded spout can be inserted. The pockets are each held closed by drawstrings which are also provided with similar slide fasteners.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
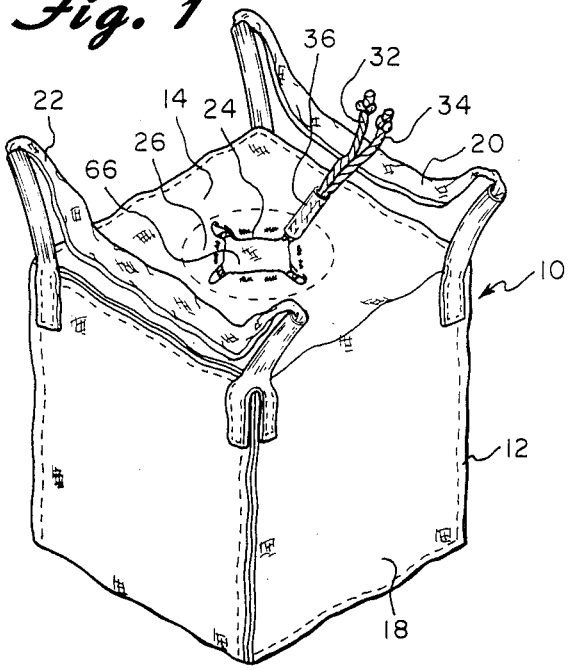
FIG. 1 is a top perspective view of a flexible bulk container constructed in accordance with the principles of the present invention.
Figure 2:
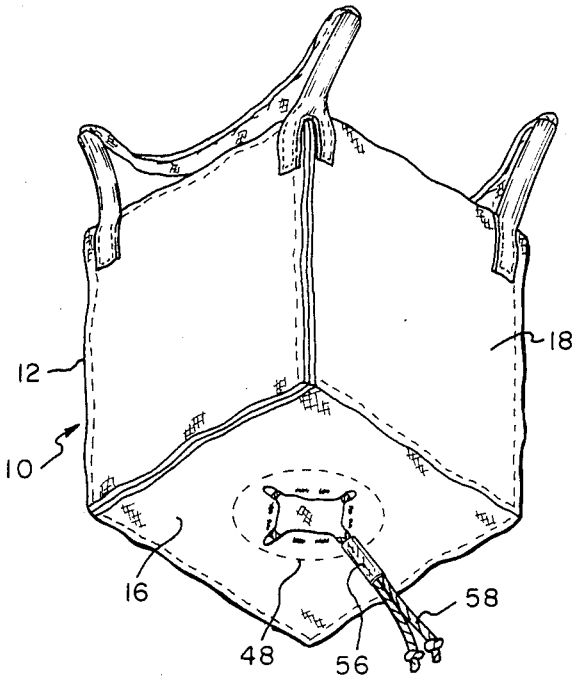
FIG. 2 is a bottom perspective view thereof.

Referring now to the drawings in detail wherein like reference numerals have been used throughout the various figures to designate like elements, there is shown in FIGS. 1 and 2 a flexible bulk container constructed in accordance with the principles of the present invention and designated generally as 10. FIG. 1 is a perspective view of the container 10 from the top thereof and FIG. 2 is a similar perspective view but taken from the bottom. The container 10 is comprised of a bag portion 12 including a top wall 14, a bottom wall 16 and surrounding side walls 18. The bag 12 does not, per se, form a part of the instant invention and can be constructed in a conventional manner from woven polypropylene or other desired material.

A pair of lifting strap loops 20 and 22 are provided adjacent the top of the container for the purpose of transporting the same by a forklift truck or the like. The manner in which the loops 20 and 22 are designed and the manner in which they function are more fully described in Applicant's co-pending application Ser. No. 455,194, filed Jan. 3, 1983, U.S. Pat. No. 4,499,599. The subject matter of that application is incorporated fully herein by reference.

Both the top wall 14 and bottom wall 16 are provided with spouts which are used for filling the container with material and for discharging material from the container; the filling spout being provided on the top wall 14 and the discharge spout on the bottom wall 16. With one minor exception which will be described more fully hereinafter, the two spouts, the manner in which they are connected to their respective walls and the manner in which they are opened and closed are substantially identical. Accordingly, while the following detailed description may specifically refer to only one of the two spouts, it will be understood that the other is constructed in a similar manner.

Figure 3:
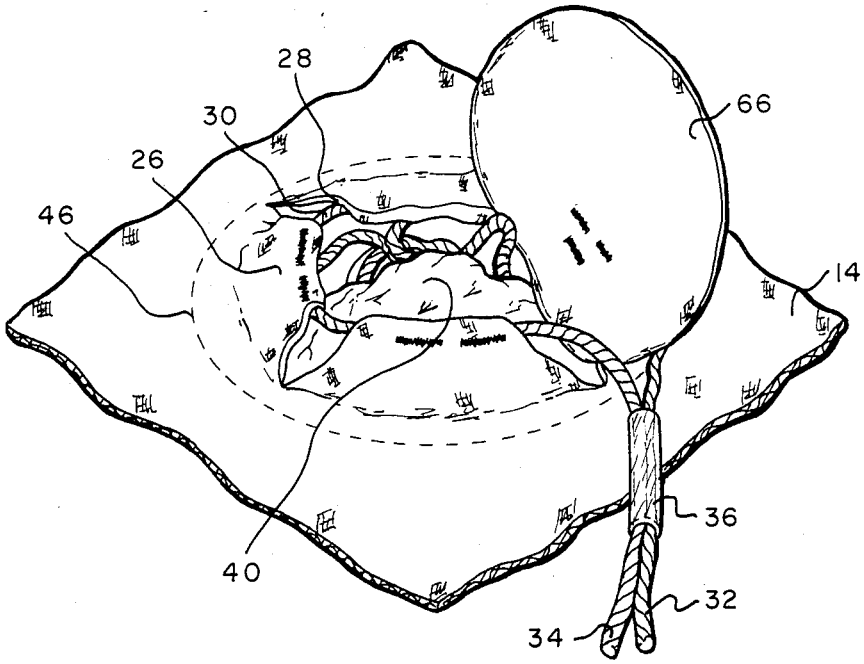
FIG. 3 is an enlarged perspective view of a portion of the top of FIG. 1 showing the details of the spout portion of the container in its partially open position.
Figure 4:
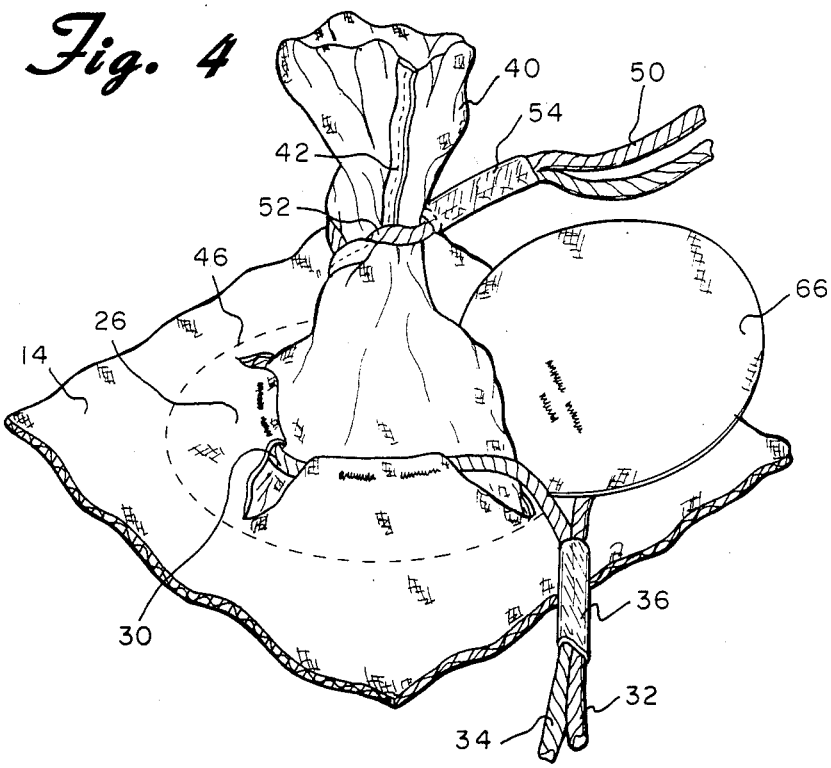
FIG. 4 is a view similar to FIG. 3 but showing the spout in an extended but closed condition.

With reference to FIGS. 1, 3 and 4, it can be seen that the top wall 14 is provided with an opening 24 substantially centrally located thereof. The opening 24 is formed by cutting an "X" in the top wall and then folding the remaining four flaps inwardly and stitching or otherwise securing the end portion of each flap to itself. A loop or opening remains at the end of each flap 26 and a drawstring or cord 30 is run through the loops 28.

As will become more apparent hereinafter, the flaps 26 form the equivalent of a pocket which can be either in the closed position as shown in FIG. 1 or the substantially open position as shown in FIG. 4. The closed position is attained by pulling on the two free ends 32 and 34 of the cord 30. Once the cord ends 32 and 34 are drawn to close the pocket, they are held in position by the use of slide fastener 36.

Fastener 36, as shown most clearly in FIG. 4, is comprised of an elongated piece of clear, flexible plastic tubing. The inner diameter of the tubing and the rigidity or flexibility thereof are selected so that a relatively tight frictionally fit is formed between the fastener 36 and the two ends 32 and 34 of the cord 30 which pass therethrough. The frictional fit is such that the fastener 36 can be manually slid along the length of the tubing by a workman physically grasping the same but the fastener will then tend to remain in the position into which it has been manually slid. Thus, once the fastener 36 is moved into the closed position shown in FIG. 1, it will tend to stay in that position thereby closing the plurality of flaps 26. The flaps 26 and, therefore, the pocket which is formed thereby are opened as shown in FIG. 4 by manually sliding the fastener 36 away from the center of the bag and toward the free ends of the cord 30.

The spouts, per se, are comprised essentially of a piece of flexible fabric material which may be the same material from which the walls of the bag itself are made. The shape of the spout is preferably substantially cylindrical as illustrated by the discharge spout 38 shown in FIG. 5. The filling or loading spout is illustrated at 40 in FIG. 4. Each spout is made by forming a rectangular piece of material into a cylinder and stitching the edges together as shown at 42 in FIG. 4 and 44 in FIG. 5. The innermost edge of spout 40 is stitched or otherwise secured to the inside of the top wall 14 at the outer perimeter of the flaps 26 as shown at 46 in FIG. 4. The discharge spout 38 is similarly stitched to the inside surface of the bottom wall 16 such as shown at 48 in FIG. 5.

Referring now to FIG. 4, it can be seen that the spout 40 is provided with a cord 50 which is substantially identical to cord 30. At approximately the midpoint 52 of the cord 50, the same is attached to the spout 40 by stitching the same to the seam or stitching 42. This prevents the cord 50 from falling off and becoming lost when the spouts are opened.

Figure 5:
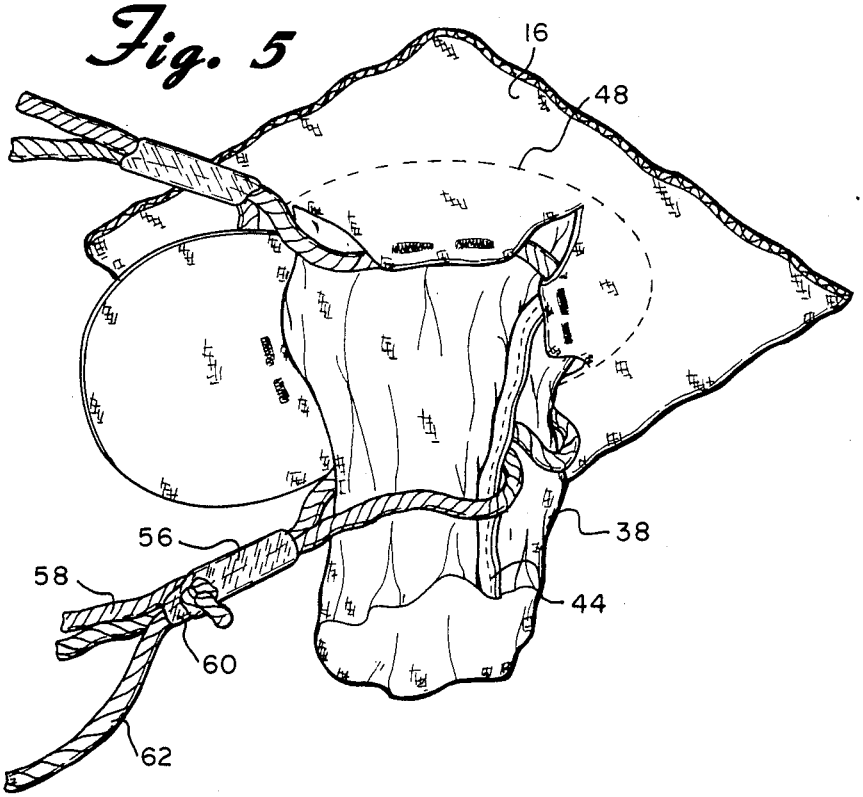
FIG. 5 is a view similar to FIG. 4 but showing the discharge spout in its open position.

Cord 50 is also provided with an elongated tube slide fastener 54. Fastener 54 is substantially identical to fastener 36 and cooperates with the two ends of the cord 50 in substantially the same manner as fastener 36. Thus, the fastener 54 can be manually slid forwardly toward the spout 40 to close the same as shown in FIG. 4 or it can be manually slid away from the spout 40 to open the same. FIG. 5 shows fastener 56 slid outwardly on cord 58 away from the discharge spout 38 so that the discharge spout is in its open position. As with fastener 36, fasteners 54 and 56 tend to remain in the position to which they have been manually slid.

When it is desired to empty the contents from the container 10, the same is normally lifted into a position where it overlies the receptacle into which the material is to be discharged. At that point, a workman must open the discharge spout. With conventional flexible bulk containers, this meant untying the knot in the cord which may be closing the spout and with the present invention this requires the workman to manually move the slide fastener 56 from the closed position outwardly to the open position. Since the bag 12 may be carrying powdered or granular material in excess of two tons, this procedure can be potentially dangerous for the workman.

Figure 6:
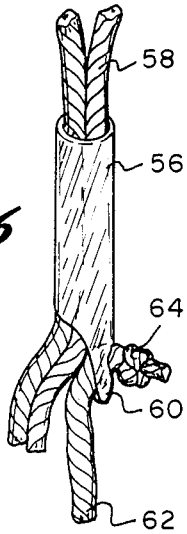
FIG. 6 is an enlarged view of the discharge spout slide fastener of FIG. 5.

The present invention provides a safety mechanism for helping to prevent injuries to a workman by providing a means for remotely opening the discharge spout 38. As shown in FIGS. 5 and 6, the slide fastener 56 which is fitted around the cord 58 includes a forward extension 60 thereon. An additional cord 62 is secured to the forward end 60 of the slide fastener 56 by passing the end thereof through a hole formed in the fastener and by thereafter forming a knot 64 therein. It can thus be seen that the slide fastener 56 can be slid along the cord 58 to open the discharge spout 38 by pulling on the remote end of the additional cord 62. The length of the cord 62 is selected so that the workman can be in a remote and safe position several feet from the bag 12.

It should be noted that with the present invention it is not necessary to totally open the discharge spout 38. In some applications, it may be desirable to only partially open the spout. This can be accomplished by the present invention by merely pulling the fastener 56 only partly away from the closed position so that the spout is only partially opened. Furthermore, if it is ever desired to stop the flow of material from the discharge spout 38, it is only necessary to again slide the fastener 56 inwardly toward the spout to again tighten the cord 58 therearound. This is a significant advantage over the prior art wherein the spout is either entirely opened or entirely closed. Furthermore, with prior art devices, no means are available for closing a discharge spout once the same is opened.

The procedure for closing a spout is best illustrated by viewing FIGS. 1, 3, 4 and 5 in reverse order. FIG. 5 shows the discharge spout 38 in its fully open condition. To close the spout 38, per se, the slide fastener 56 is manually moved toward the spout along the cord 58 until the cord 58 tightly encircles the spout. This is illustrated in FIG. 4 where the slide fastener 54 is slid forwardly and the cord 50 tightly closes the spout 40. At this point, the flexible and closed spout 40 is then folded over upon itself and is then tucked under one or more of the flaps 26 into the pocket which is formed between the underside of the flaps 26 and the inner peripheral portion of the spout. The spout 40 is now in the position shown in FIG. 3.

After the spout 40 is inserted into the pocket, a flexible disk-shaped member 66 is then placed over the folded spout and has its peripheral edges tucked under the flaps 26. Preferably, the disk-shaped member 66 has a portion thereof permanently secured to one of the flaps 26 so that it is easily accessible and does not become lost. With the disk-shaped member 66 in its proper position over the spout 40 and under the flaps 26, the ends 32 and 34 of the cord 30 are then drawn tightly outwardly to close the flaps 26 tightly around the disk 66 and the underlying spout 40. The slide fastener 36 is then slid forwardly to maintain the flaps in their closed position as shown in FIG. 1. It should be readily apparent that the spout is opened by simply reversing the above-described procedure.

The present invention may be embodied in other specific forms without departing from the spirit or essential attributes thereof and accordingly reference should be made to the appended claims rather than to the foregoing specification as indicating the scope of the invention.

I claim:

1. In a flexible bulk container including a bag portion having a top wall, a bottom wall and an encircling side wall connected to said top and bottom walls defining the outer perimeter of said bag portion and further including a filling spout secured to said top wall for filling said bag portion and a discharge spout secured to said bottom wall for discharging material from said bag portion, each of said spouts including a cord attached thereto intermediate the ends of said cord and which is adapted to be tightened around its respective spout for closing the same, the improvement comprising a pocket formed in the wall around each spout, each spout being adapted to be folded and inserted into its respective pocket; each pocket being comprised of a plurality of flaps which are adapted to be moved between open and closed positions, a pull cord for holding said flaps in said closed position with the respective spout inserted within said pocket; a fastener for holding each of said cords in a tightened position after the cord has been tightened around its associated spout for closing the same or for holding the cord in a position wherein it closes its associated flaps; each of said fasteners being comprised of an element having an aperture therein through which both ends of one of said cords are passed, the inner diameter of said aperture being such that it frictionally engages the cord so that said element can be manually slid across its respective cord ends between a closed position and an open position, said element tending to remain in any position in which it is placed; the fastener associated with the discharge spout having an additional cord attached thereto so that said fastener can be operated and slid into an open position from a remote location.

2. The invention as claimed in claim 1 wherein each of said fasteners is comprised of flexible plastic tubing.

3. The invention as claimed in claim 1 further including a flexible disk-shaped member associated with each spout and adapted to fit over its respective spout when the spout is folded and inserted in its pocket.

* * * * *